US005791796A

United States Patent [19]

Gustavsson et al.

[11] Patent Number: 5,791,796

[45] Date of Patent: Aug. 11, 1998

[54] THERMAL PRINTER WITH SPRING BIASED DRIVE ROLLER/PLATEN

[75] Inventors: Vigo H. Gustavsson, Simi Valley; Philip S. Bryer, Tarzana; Dean H. Lodwig, West Hills, all of Calif.

[73] Assignee: Eltron International, Inc., Simi Valley, Calif.

[21] Appl. No.: 747,332

[22] Filed: Nov. 12, 1996

Related U.S. Application Data

[60] Provisional application No. 60/006,444 Nov. 13, 1995.

[51] Int. Cl.[6] ..... B41J 29/02

[52] U.S. Cl. ..... 400/693; 400/120.01; 400/613; 347/223

[58] Field of Search ..... 400/693, 120.01, 400/613; 347/223, 220, 222

[56] References Cited

U.S. PATENT DOCUMENTS

| | | | |
|---|---|---|---|
| 3,851,942 | 12/1974 | Clay et al. | 292/204 |
| 4,614,949 | 9/1986 | Hakkaku et al. | 400/356 |
| 4,639,739 | 1/1987 | Tsutsumi | 400/593 |
| 4,741,634 | 5/1988 | Nozaki et al. | 400/120.11 |
| 4,838,713 | 6/1989 | Kunimitsu et al. | 400/120 |
| 4,848,945 | 7/1989 | Sone | 400/613 |
| 5,201,588 | 4/1993 | Sakai et al. | 400/693 |
| 5,230,576 | 7/1993 | Sone | 400/613 |
| 5,366,302 | 11/1994 | Masumura et al. | 400/120.16 |

FOREIGN PATENT DOCUMENTS 8-318661 12/1996 Japan .

*Primary Examiner*—Edgar S. Burr
*Assistant Examiner*—Daniel J. Colilla
*Attorney, Agent, or Firm*—Freilich, Hornbaker & Rosen

[57] ABSTRACT

A low cost small footprint thermal printer including a thermal print head and a motor drive roller/platen mounted opposite to the print head for pinching web material therebetween to draw said material from a supply roll and advance it past said print head. The roller/platen is mounted on a hinged door which can be opened to provide access to a supply roll compartment and closed to position the roller/platen in operative relationship adjacent to the print head. In its closed operative position, the roller/platen is spring biased against a fixedly mounted print head.

8 Claims, 8 Drawing Sheets

THERMAL PRINTER WITH SPRING BIASED DRIVE ROLLER/PLATEN

This application claims the benefit of U.S. Provisional Application No. 60/006.444 filed Nov. 13, 1995.

BACKGROUND OF THE INVENTION

This invention relates generally to printers capable of being driven by computer output for printing receipts, labels, and the like, and more particularly to thermal printers for printing on web material peeled from a paper (or other printing media) supply roll.

Computer driven thermal printers are widely used in diverse applications for printing receipts, labels, etc. Such printers typically use a paper supply roll from which web material is peeled and then advanced along a web path between a thermal print head and a motor driven roller/platen. Typically, the print head is spring mounted and urged against the roller/platen, pinching the web therebetween, thus enabling the roller/platen to pull the web from the supply roll and feed it past the head for printing.

SUMMARY OF THE INVENTION

The present invention is directed to a low cost small footprint thermal printer including a thermal print head and a motor driven roller/platen mounted opposite to the print head for pinching web material therebetween to draw said material from a supply roll and advance it past said print head. In accordance with the invention, the roller/platen is mounted on a hinged door subassembly which can be opened to provide access to a supply roll compartment and closed to position the roller/platen in operative relationship adjacent to the print head. In its closed operative position, the roller/platen is spring biased against a fixedly mounted print head.

In a preferred embodiment, the print head is carried by a circuit board which is mounted on a frame. The door subassembly is spring mounted on the frame and movable between an open position which allows access to an internal compartment for accommodating a web supply roll and a closed position in which the roller/platen is located immediately adjacent to the print head. The spring mounting between the frame and the door subassembly biases the roller/platen against the print head.

In accordance with a significant feature of the preferred embodiment, the door subassembly includes a door, the roller/platen (or "drive roller") and a motor and drive, train for driving the roller.

In accordance with a further aspect of the preferred embodiment, the thermal print head is mounted to a heat sink which, in turn, is mounted adjacent an edge of the circuit board. An edge surface of the heat sink is positioned to facilitate alignment of the door as it is moved from its open position to its closed position to thereby align the print head and drive roller.

In accordance with a still further aspect of the preferred embodiment a latch is provided for automatically detenting the door subassembly in the closed position. The preferred latch structure is comprised of a block element mounted on the frame and a cam element mounted on the door subassembly. The block and cam elements define complementary surfaces enabling the cam element to move past the block element by bending the spring to allow the door subassembly to translate perpendicular to its hinge axis as it is rotated to its closed position. When in the closed position, the spring positions the cam element so that it is blocked by the block element thus detenting the door subassembly in the closed position.

In accordance with a still further feature of the preferred embodiment, a sensor is mounted on the circuit board proximate to the print head for detecting "top-of-form" and a "paper out" condition.

In accordance with another aspect of the preferred embodiment, guide ribs are provided on the inner surface of the door to project into the compartment to contact and position the supply roll to guide the web along a path between the roller and print head.

Although plain thermal paper is perhaps the most frequently used printing media in typical applications of the invention, it should be understood that various other media in various web roll formats can also be used. For example only, embodiments of the invention can be used with various forms of label paper on rolls with or without central cores, and either with or without a web backing.

DETAILED DESCRIPTION

Figure 1:
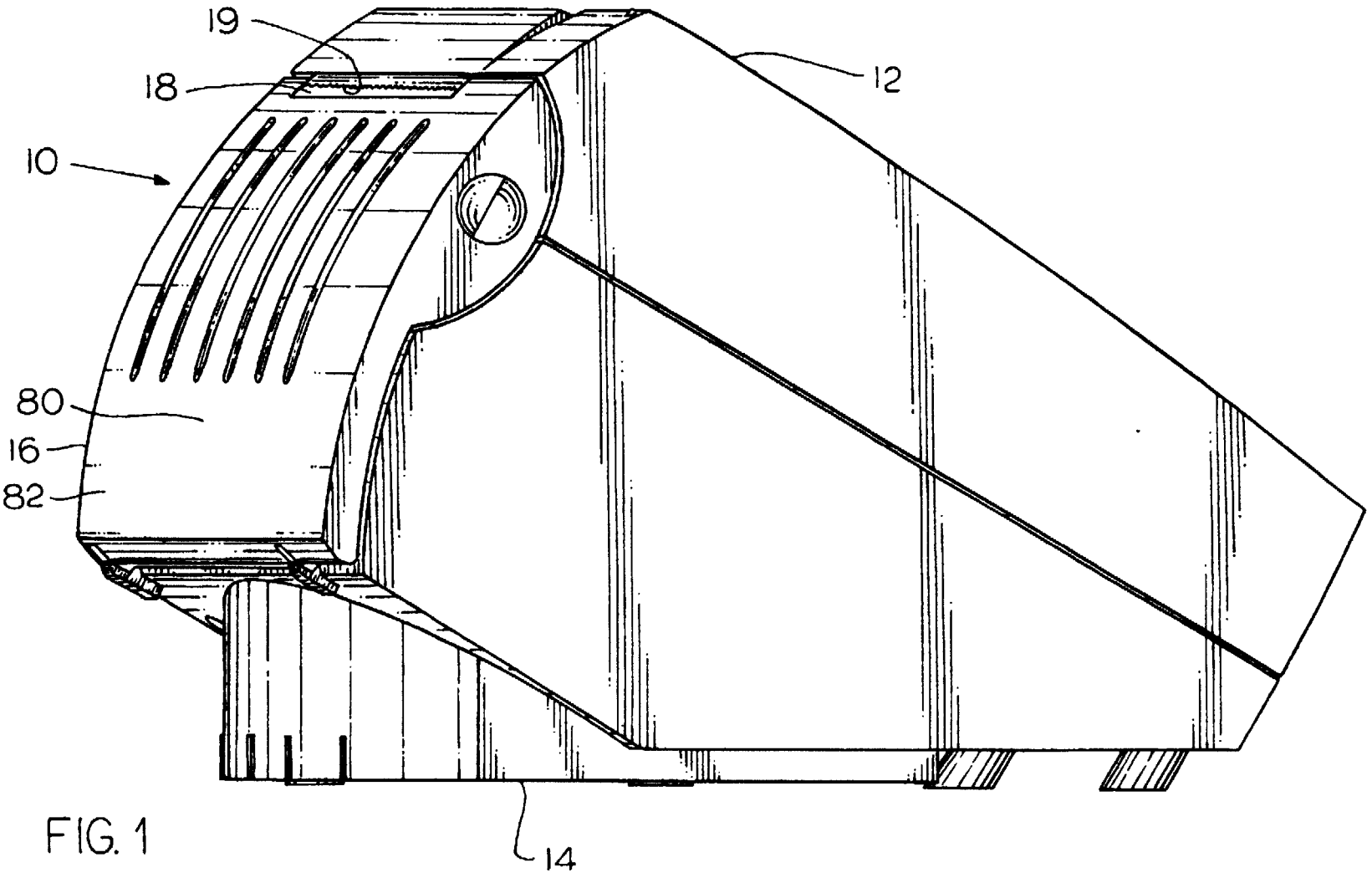
FIG. 1 is an isometric side view of a printer housing in accordance with the invention showing the door subassembly in a closed position.
Figure 2:
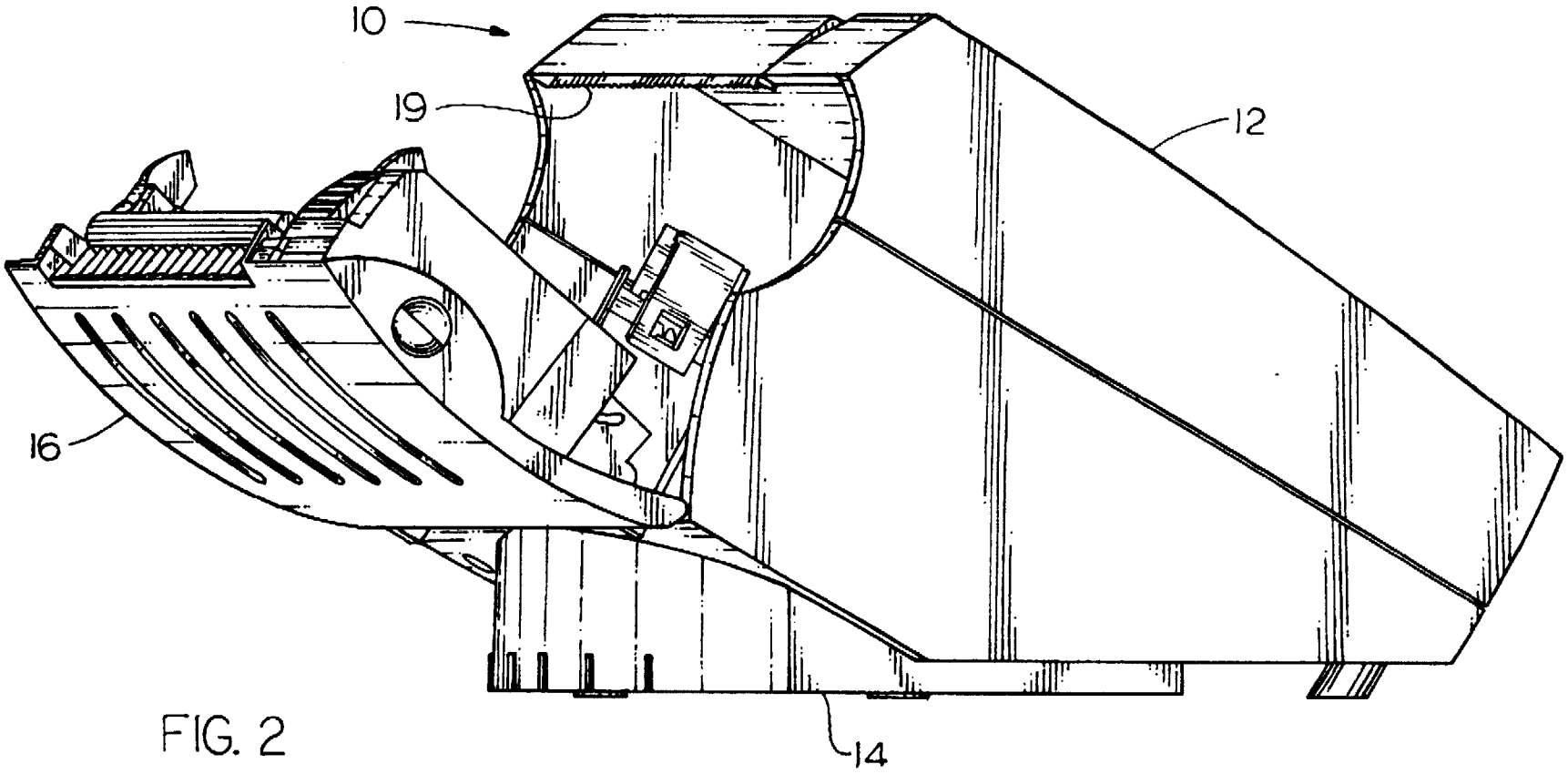
FIG. 2 is an isometric side view similar to FIG. 1 but showing the door subassembly in its open position.
Figure 3:
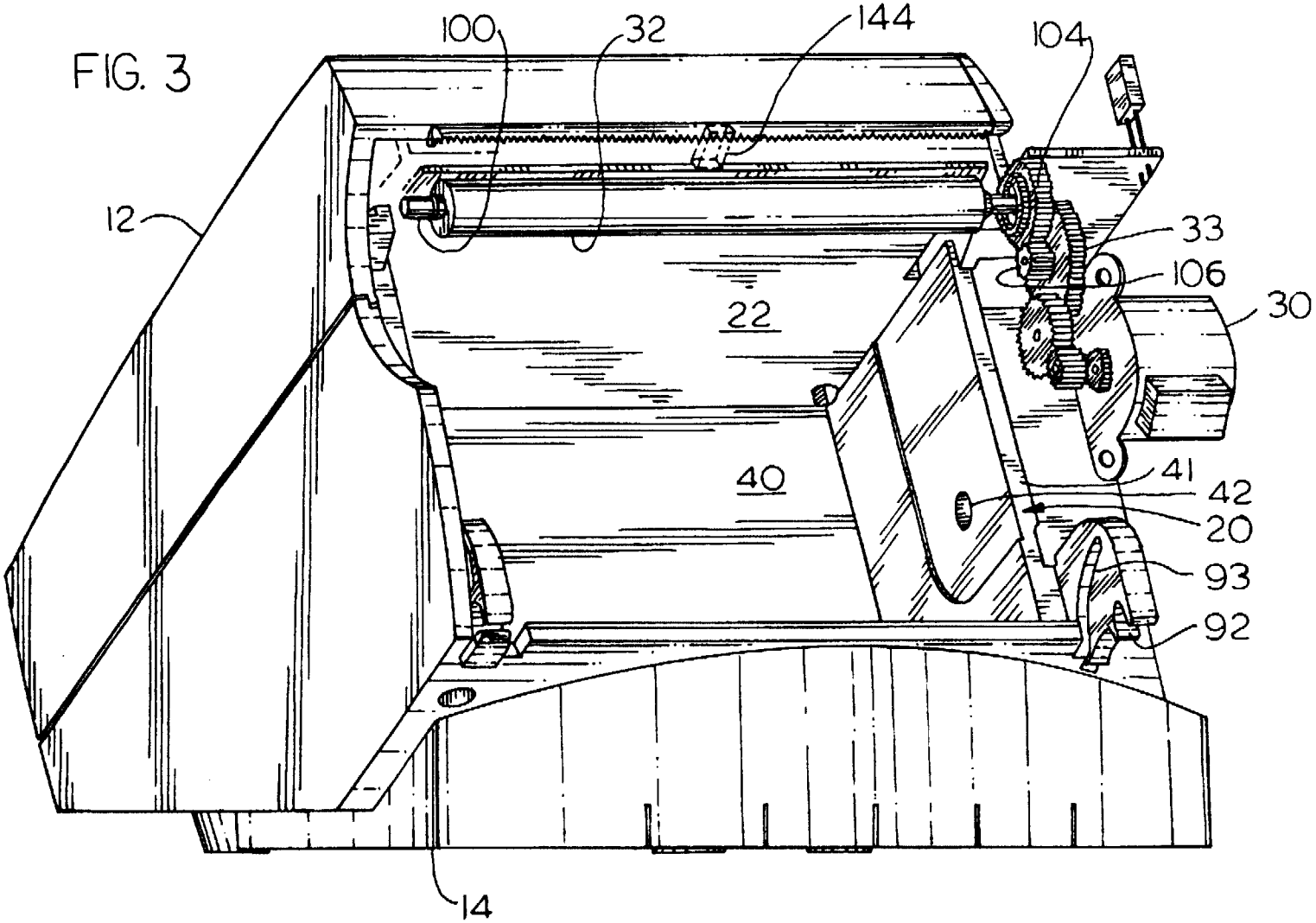
FIG. 3 is an isometric front view of the housing with most of the door subassembly removed to show the frame and internal roll compartment.

Attention is initially directed to FIGS. 1 and 2 which comprise isometric views of a low cost small foot print thermal printer 10 in accordance with the invention respectively showing the printer door subassembly closed and open. Printer 10 is suitable for printing receipts, labels, and the like in various applications such as point-of-sale (POS) situations. As seen in FIGS. 1 and 2, the printer 10 is primarily comprised of a main housing 12, supported on a detachable base 14, preferably at an inclined orientation, and a door subassembly 16 which is hinged for movement between the closed position shown in FIG. 1 and the open position shown in FIG. 2. A web discharge slot 18 is positioned between the door subassembly 16 and a tear bar 19 carried by housing 12.

With continuing reference to FIGS. 3–6, the printer 10 is comprised primarily of the following major components:

A frame 20;

A circuit board 22 supported on frame 20 and carrying a heat sink 24 and thermal print head 26;

A door subassembly 16 carrying a motor 30 coupled to drive roller/platen 32 via drive train 33; and A pair of springs 36 mounted between the frame 20 and the door subassembly 16 for biasing the door upward to urge the roller/platen 32 against the print head 26 when the door is in its closed position.

The frame 20 defines an internal compartment 40, between side walls 41, dimensioned to accommodate a printing media, typically paper, web supply roll (not shown) so as to enable web material to be drawn from the roll by roller/platen 32 and fed past the print head 26 out through discharge slot 18. The roll is either loosely accommodated in compartment 40 or may be mounted for rotation about an axis defined by sidewall holes 42.

Figure 5:
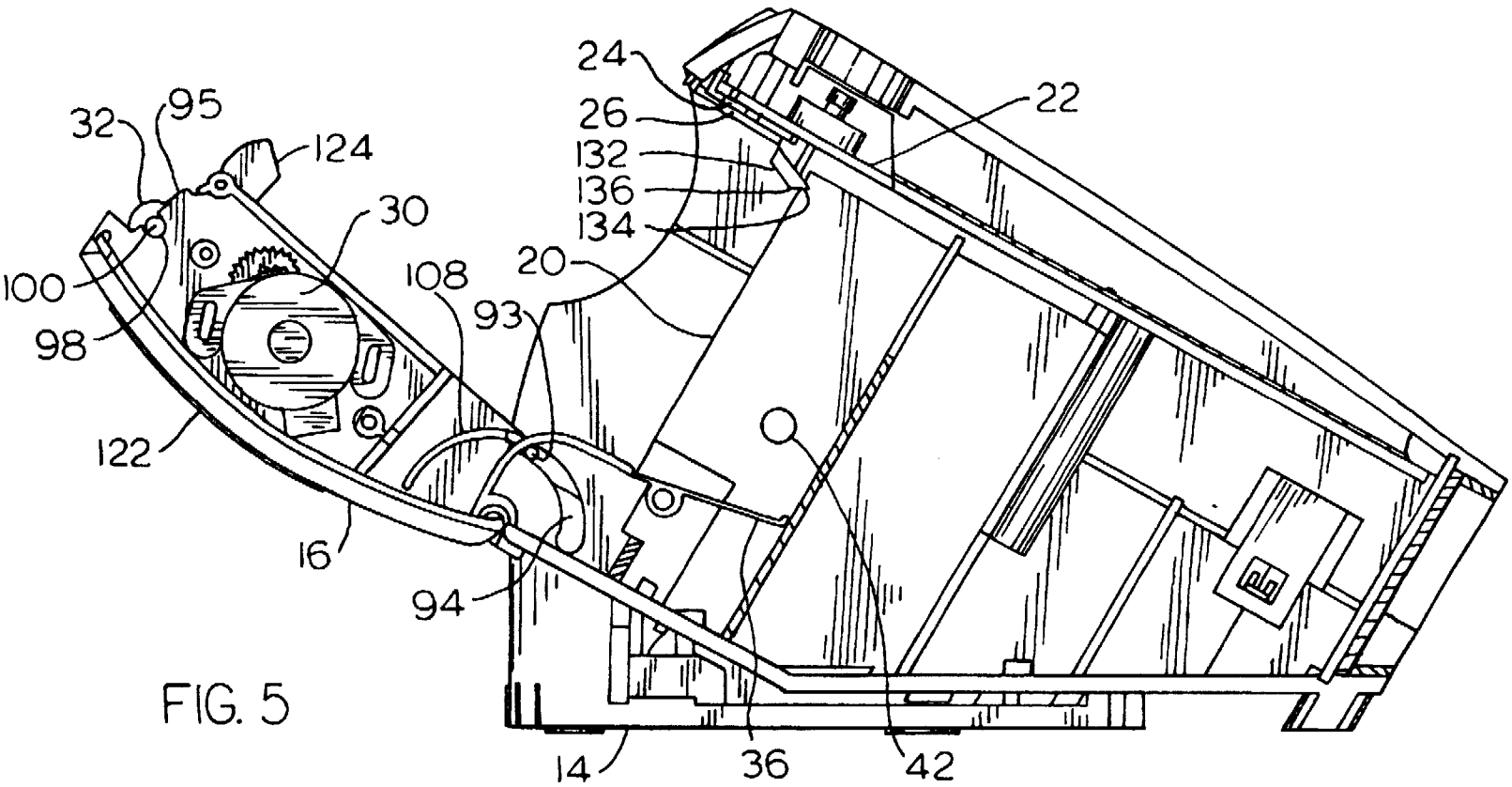
FIG. 5 is a side sectional view of the printer of FIG. 1 showing its basic internal configuration with the door subassembly in its open position.
Figure 6:
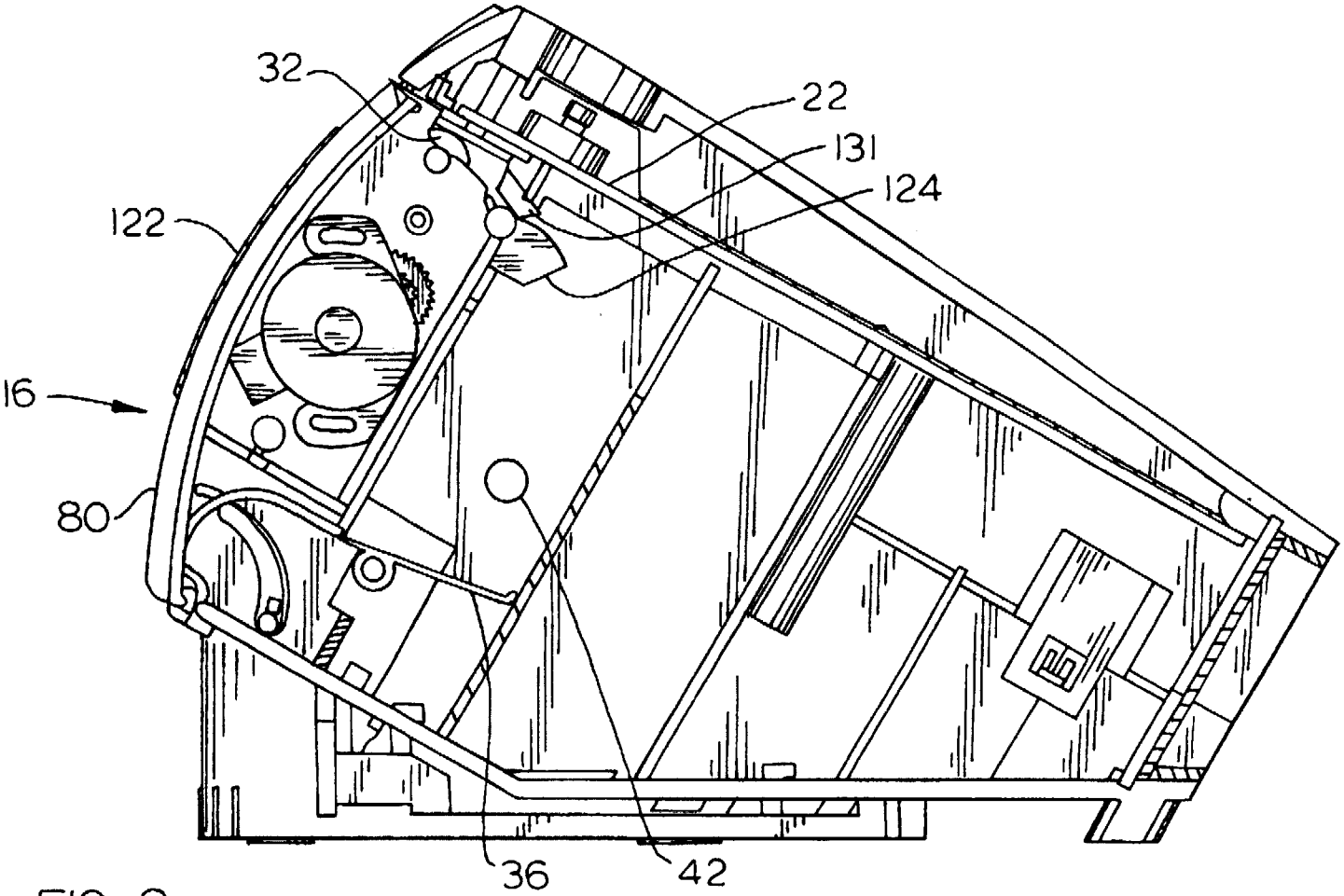
FIG. 6 is a side sectional view similar to FIG. 5 but showing the door subassembly in the closed position.
Figure 7:
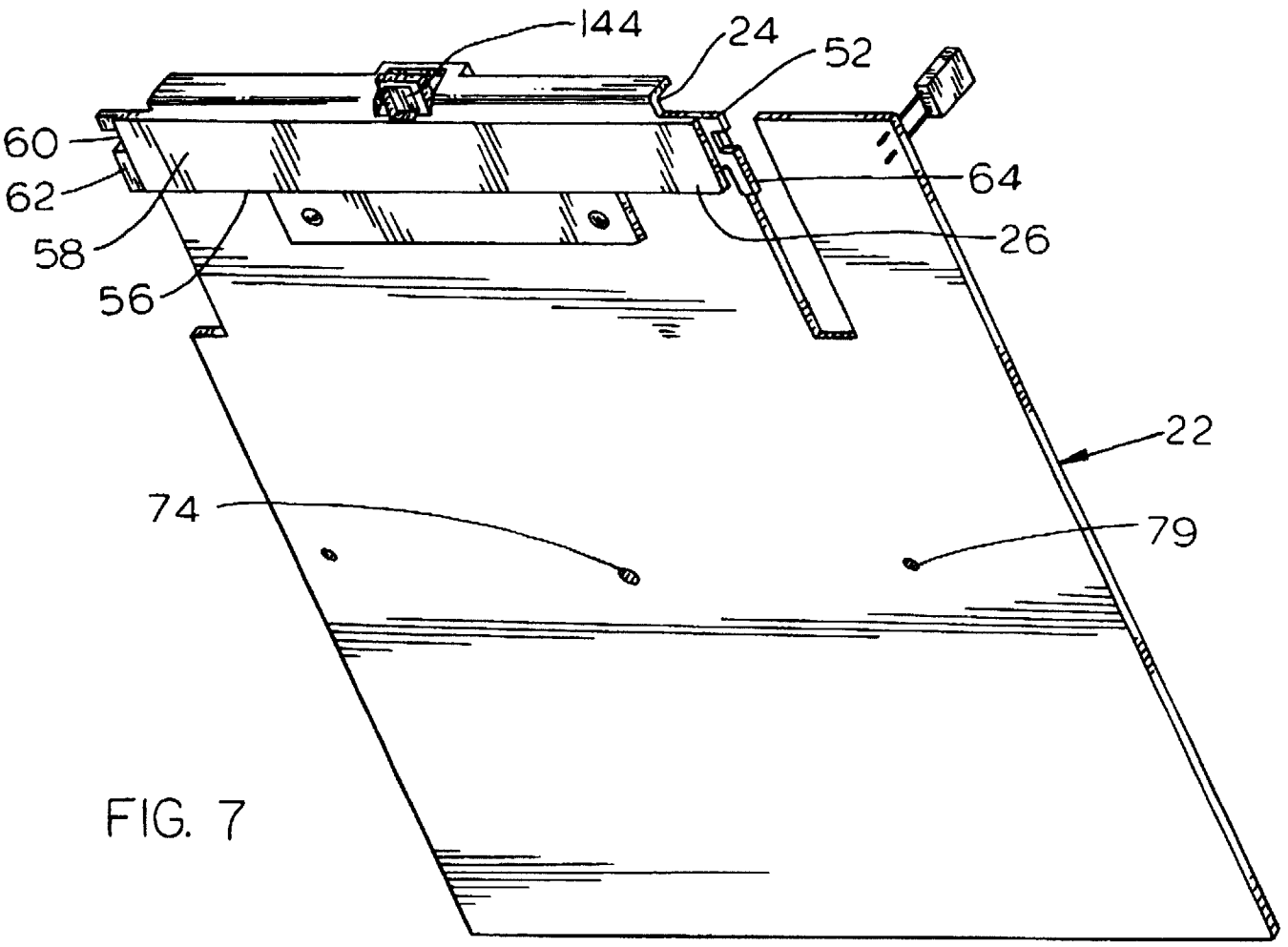
FIG. 7 is an isometric view of the circuit board bottom surface primarily showing the print head, heat sink, and web sensor.
Figure 8:
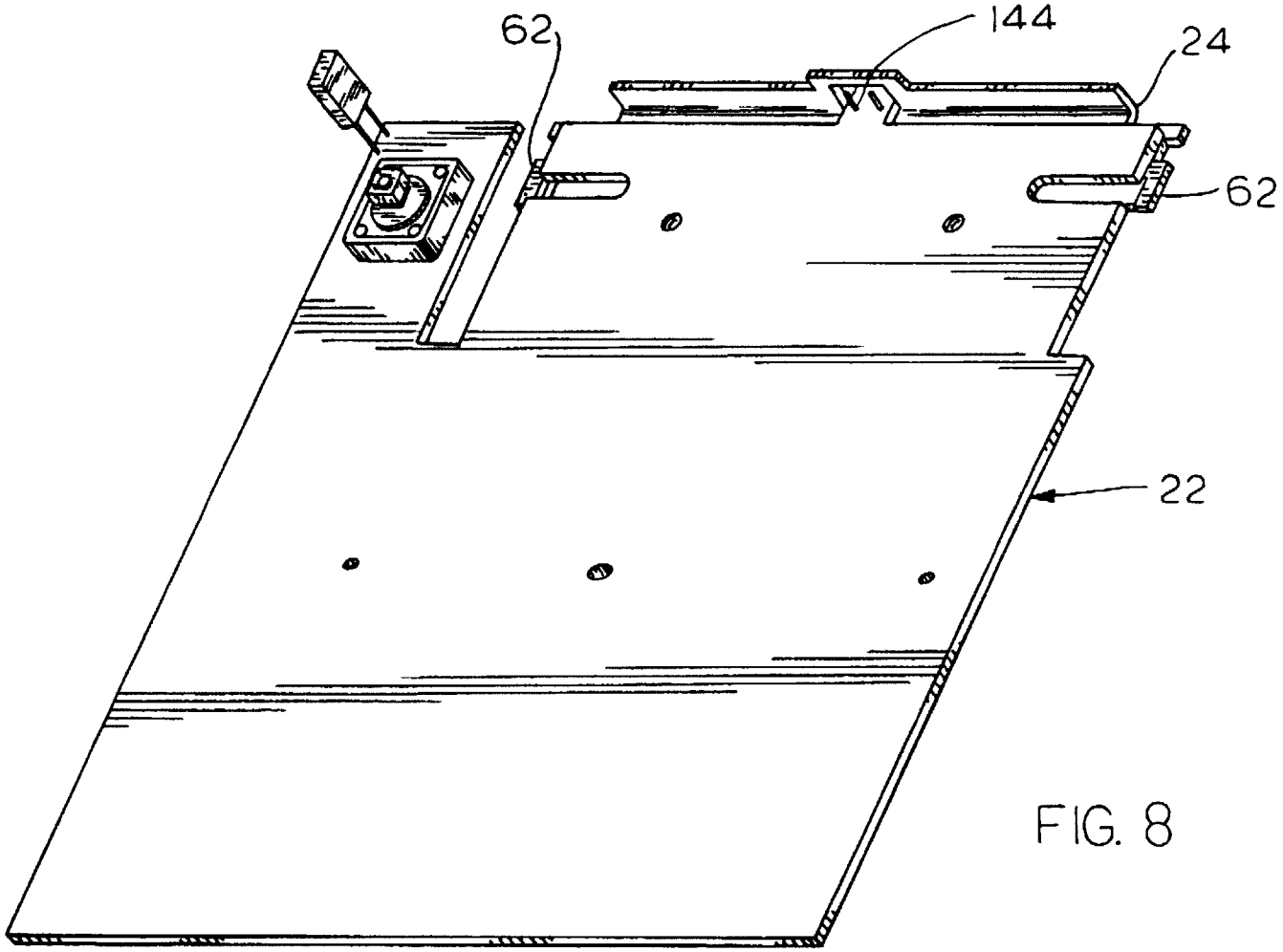
FIG. 8 is an isometric view of the circuit board top surface.

The printed circuit board 22 shown in FIGS. 5 and 6 is depicted in detail in FIGS. 7 and 8. Note that heat sink 24 is mounted on the circuit board proximate to its leading edge 52. The print head 26 is in turn mounted on the heat sink 24. The print head typically comprises a slice of ceramic material 56 carrying a plurality of heating elements 58 aligned along print line 60. Note that the ends 62, 64 of the heat sink 24 are shown as extending beyond the print head 26. As will be mentioned hereinafter, these ends 62, 64 cooperate with stops 70 formed on the frame to facilitate precise positioning of the board 22 relative to the frame 20.

Additionally, the board 22 defines a mounting hole 74 positioned to receive a fastener (not shown) extending into frame hole 76. When the circuit board 22 is installed on the frame, posts 78 align with board holes 79 and frame hole 76 aligns with board hole 74. Consequently, the board 22 is positioned with the heat sink ends 62, 64 against the stops 70 to precisely position the heat sink and print head line 60 relative to the frame 20.

The door subassembly 16 is comprised of a substantially arcuate panel or door 80 having outer and inner surfaces 82, 84. Moreover, the panel 80 defines an upper edge 86 and a lower edge 88. A hinge member 90 is formed adjacent the lower edge 88 and is configured to be received for rotation in recesses 92 formed by the frame 20. The door subassembly is thus able to pivot from the closed position depicted in FIG. 1 to the open position depicted in FIG. 2. The door subassembly 16 carries a short guide pin 93 which extends parallel to hinge member 90 and is positioned to be received in arcuate slot 94 formed in frame 20. As the door subassembly 16 is rotated around the axis of hinge member 90 from its closed to its open position, pin 93 moves along slot 94 from its lower end to its upper end. It should be noted that the recesses 92 which accommodate the hinge member 90 are configured, e.g., open at the bottom, to permit limited translation of the hinge member 90 essentially perpendicular to its axis of rotation.

Extending rearwardly from the door inner surface 84 are first and second spaced walls 95, 96 which define recesses 98 at their upper ends for accommodating axle 100 fixed to the drive roller/platen 32. Axle 100 is fixed to gear 104 which, via intermediate gears 106 is coupled to drive motor 30 carried by wall 95. Energization of the motor 30 rotates the drive roller/platen 32. Walls 95, 96 respectively, define arcuate slots 108 which accommodate inwardly turned forward ends 112 of springs 36. Each spring 36 includes a rearward end 114 which is anchored to the frame and a center portion 116 configured for mounting on frame post 118. Each spring 36 is configured so that it acts to bias the door subassembly 16 upward, i.e. to urge hinge member 90 to the top of recess 92. Thus, when the door subassembly 16 is in its closed position as depicted in FIG. 2, springs 36 urge drive roller/platen 32 upwardly against print head 26. The contact line between the cylindrical roller/platen 32 and the print head 26 is along print line 60. In use, prior to moving the door subassembly to the closed position, the web is pulled forwardly through slot 18 past tear bar 19, and beyond the print station defined by print line 60. When the door subassembly 16 is closed, the web is pinched between the spring urged roller/platen 32 and the print head 26. As a consequence, when the roller/platen 32 is driven in a counterclockwise direction (as viewed in FIG. 6), it will peel the web from the top of the supply roll (not shown) and advance it past the print line 60.

Figure 4:
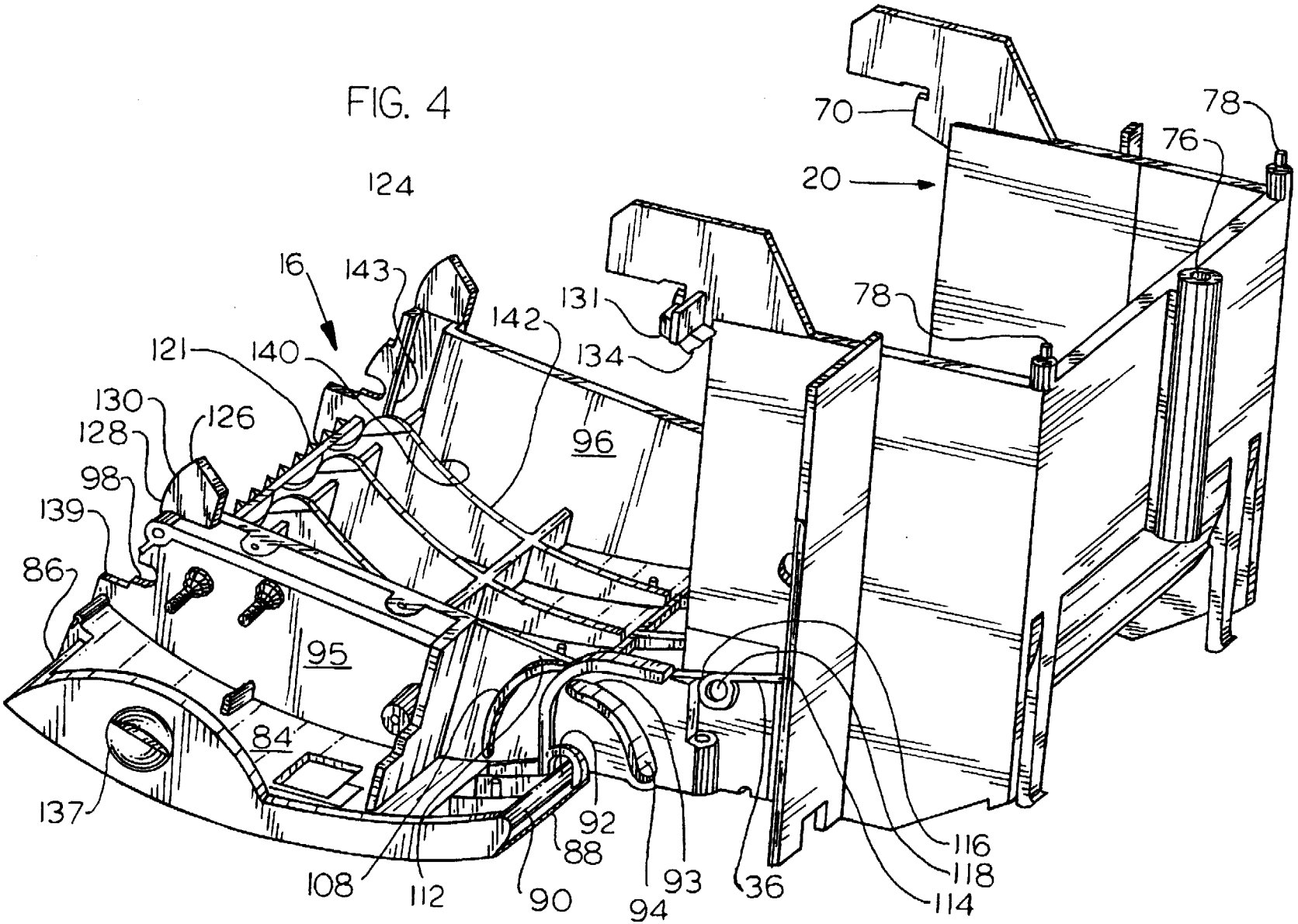
FIG. 4 is an isometric view showing the inner surface of the door subassembly relative to the frame.

It should be noted, e.g., FIG. 4, that the upper edge of the door subassembly 16 defines a serrated surface comprised of sharp peaks 121. These peaks are desirable to minimize contact between the back surface of the web material and surfaces of the door subassembly 16 for the purpose of enabling adhesive backed fineness material to be used. The outer surface 82 of door 80 is also preferably provided with peaked ribs 122.

The door walls 95, 96 respectively carry cam elements 124 which are used for latching the door subassembly 16 in the closed position. The cam elements 124 each define a rearward inclined surface 126 and a forward inclined surface 128 meeting at an intermediate vertex 130. The cam elements 124 are positioned to cooperate with blocks 131 carried by the frame 20 for latching or detenting the door subassembly 16 in a closed position. The blocks 131 each define a forward inclined surface 132 and a rearward incline surface 134 meeting at an intermediate vertex 136.

As the door subassembly 16 is pivoted from the open to the closed position, the rearward surfaces 126 of cam elements 124 will slide along surfaces 132 of blocks 131. As a consequence of the orientation of the surfaces 126 and 132, the door subassembly 16 will be forced to translate slightly downwardly against the urging of springs 36. Once vertex 130 of cam elements 124 passes vertex 136 of blocks 131 the normal resiliency of springs 36 will move the door and cam elements upwardly to place forward surfaces 128 of elements 124 adjacent to rearward surfaces 134 of blocks 131 to thus latch the door subassembly 16 in the closed position. The door subassembly can be readily opened by a user manually grasping finger holes 137 and pulling. The cooperating surfaces will force the door subassembly slightly downwardly stressing the springs 36 and allowing cam elements 124 to move past blocks 131.

As previously mentioned, the heat sink 24 is precisely positioned relative to the frame 20 as a consequence of stops 70. The print head 26 and print line 60 are preferably referenced to the heat sink 24 when installed thereon. The roller/platen is precisely positioned relative to the door subassembly 16 by the axle 100 and recesses 98. In order to assure optimum registration of the roller/platen 32 to the print line 60, it is preferable to utilize the heat sink block 24 leading edge 138 as a reference stop against which a portion 139 of the door subassembly 16 engages in its closed position.

It is further pointed out that one or more guide ribs 140 is provided on the door subassembly 16 projecting rearwardly from the panel inner surface 84. The ribs define an arcuate guide surface 142 intended to peripherally engage the web supply roll (not shown). The guide surface 142 helps to maintain the supply roll toward the rear of compartment 40 and guide the web material peeling from the top of the roll along a direct path past roller/platen 32. The ribs preferably define sharp edges 143 at their upper ends to minimize surface contact with the rear face of the web material.

A web sensor 144 is preferably provided proximate to the forward edge of the circuit board 22 adjacent to the discharge slot 18 for sensing "top-of-form" and a "paper out" condition.

From the foregoing, it should now be understood that a low cost small foot print thermal printer has been disclosed herein which utilizes a spring urged door subassembly for engaging a drive roller/platen against a thermal print head. Although a specific preferred embodiment of the invention has been described, it should be understood that various modifications, well within the spirit and scope of the invention, may occur to those skilled in the art.

We claim:

1. An apparatus for advancing and printing on web material comprising:

a frame defining a compartment for accommodating a roll of web material;

a frame latch element carried by said frame;

a print head fixedly mounted relative to said frame;

a door subassembly including a drive roller mounted for rotation and a motor for rotating said drive roller;

a door latch element carried by said door subassembly;

said door subassembly being mounted with respect to said frame for limited manual rotation around a hinge axis between an open position affording access to said compartment and a closed position locating said drive roller immediately adjacent said print head, said door subassembly mounting permitting limited translational movement essentially perpendicular to said hinge axis; and at least one spring acting on said door subassembly in said closed position for urging (1) said drive roller against said print head to pinch a portion of said web material therebetween for feeding it past said print head and (2) said door and frame latch elements together to latch said door subassembly to said frame.

2. The apparatus of claim 1 including a circuit board mounted on said frame; and wherein said print head is fixedly mounted on said circuit board adjacent one edge thereof.

3. The apparatus of claim 2 further including a web sensor mounted on said circuit board proximate to said one edge.

4. The apparatus of claim 1 including a circuit board mounted on said frame; a heat sink mounted along one edge of said circuit board; and wherein said print head is affixed to said heat sink.

5. The apparatus of claim 4 wherein said door subassembly defines a stop surface for engaging said heat sink to precisely position said drive roller relative to print head when said door subassembly is in said closed position.

6. A printer comprising:

a frame defining a compartment for accommodating a printing media supply roll;

a print head fixedly mounted relative to said frame;

a door;

a drive roller carried by said door;

a motor mounted on said door for rotating said drive roller;

a door latch element carried by said door;

a frame latch element carried by said frame;

said door being mounted for limited manual rotation around a hinge axis oriented substantially parallel to said print head between (1) an open position affording access to said compartment and (2) a closed position closing said compartment and latching said door to said frame; said door mounting permitting limited translational movement essentially perpendicular to said hinge axis; and at least one spring acting on said door for permitting said limited translational movement of said door (1) away from said print head to allow said door to move from said open to said closed position and (2) toward said print head to urge said roller against said print head to pinch printing media therebetween and engage said door and frame latch elements in said closed position.

7. The printer of claim 6 further including a circuit board mounted on said frame; and wherein said print head is fixedly mounted on said circuit board.

8. The printer of claim 6 including at least one guide surface on said door adjacent to said compartment for positioning said supply roll in said compartment.

* * * * *